US011799231B2

(12) United States Patent
Yang et al.

(10) Patent No.: US 11,799,231 B2
(45) Date of Patent: Oct. 24, 2023

(54) ELECTRICAL CONNECTOR INCLUDING A MOVABLE TERMINAL HAVING FIRST AND SECOND BEAMS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Kai-Chieh Yang, New Taipei (TW); Wei-Ta Tseng, New Taipei (TW); Ming-Ching Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 35 days.

(21) Appl. No.: 17/510,668

(22) Filed: Oct. 26, 2021

(65) Prior Publication Data

US 2022/0131305 A1 Apr. 28, 2022

(30) Foreign Application Priority Data

Oct. 27, 2020 (CN) ..... 202022409990.8

(51) Int. Cl.

| | |
|---|---|
| ***H01R 13/502*** | (2006.01) |
| ***H01R 13/703*** | (2006.01) |
| ***H01R 13/24*** | (2006.01) |
| *H01R 13/6581* | (2011.01) |

(52) U.S. Cl.

CPC ..... *H01R 13/502* (2013.01); *H01R 13/2442* (2013.01); *H01R 13/7033* (2013.01); *H01R 13/6581* (2013.01)

(58) Field of Classification Search

CPC ..... H01R 13/502; H01R 13/2442; H01R 13/7033; H01R 13/6581

USPC ..... 439/188

See application file for complete search history.

(56) References Cited

U.S. PATENT DOCUMENTS

| | | | | |
|---|---|---|---|---|
| 6,585,532 | B2 * | 7/2003 | Uratani | H01R 24/46 200/51.1 |
| 6,751,317 | B2 * | 6/2004 | Shima | H01R 13/7033 379/438 |
| 7,726,992 | B2 * | 6/2010 | Wang | H01R 13/7033 439/944 |
| 7,794,253 | B2 * | 9/2010 | Wang | H01R 24/46 439/63 |

(Continued)

FOREIGN PATENT DOCUMENTS

| | | | | |
|---|---|---|---|---|
| JP | 2015216134 A | * | 12/2015 | H01R 24/46 |
| WO | WO-2014013833 A1 | * | 1/2014 | H01R 13/6277 |
| WO | WO-2014013834 A1 | * | 1/2014 | H01R 24/46 |

*Primary Examiner* — Peter G Leigh

(74) *Attorney, Agent, or Firm* — Ming Chieh Chang

(57) ABSTRACT

An electrical connector includes: an insulative base; a fixed terminal secured to the insulative base; and a movable terminal including a securing portion fixed to the insulative base, a connecting portion, a contacting portion in touch with the fixed terminal, a first and a second beams at two opposite sides of the connecting portion, and a tail, wherein at least one of the first and second beams has a first portion substantially perpendicular to the connecting portion and a second portion substantially parallel to the connecting portion.

4 Claims, 12 Drawing Sheets

(56) References Cited

U.S. PATENT DOCUMENTS

| | | | | |
|---|---|---|---|---|
| 8,066,516 | B2 * | 11/2011 | Hoshiba | H01R 24/44 439/63 |
| 8,535,074 | B2 * | 9/2013 | Hirakawa | H01R 24/46 439/63 |
| 8,986,043 | B2 * | 3/2015 | Hirakawa | H01R 9/05 439/63 |
| 9,077,130 | B2 * | 7/2015 | Hashimoto | H01R 24/46 |
| 9,236,695 | B2 * | 1/2016 | Hoshiba | H01R 24/46 |
| 9,281,636 | B1 | 3/2016 | Schmitt | |
| 9,281,639 | B2 * | 3/2016 | Yang | H01R 24/50 |
| 9,305,720 | B2 * | 4/2016 | Chen | H01H 9/02 |
| 9,312,621 | B2 * | 4/2016 | Chen | H01R 13/03 |
| 9,385,492 | B2 * | 7/2016 | Chen | H01R 24/46 |
| 9,502,835 | B2 * | 11/2016 | Chen | H01R 24/46 |
| 9,551,739 | B2 * | 1/2017 | Osaki | H01R 24/46 |

* cited by examiner

ELECTRICAL CONNECTOR INCLUDING A MOVABLE TERMINAL HAVING FIRST AND SECOND BEAMS

BACKGROUND OF THE INVENTION

1. Field of the Invention

The present invention relates to an electrical connector comprising an insulative base, a fixed terminal secured to the insulative base, and a movable terminal including a securing portion fixed to the insulative base, a connecting portion, a contacting portion in touch with the fixed terminal, and a tail, wherein a first and a second beams are disposed at two opposite sides of the connecting portion.

2. Description of Related Arts

U.S. Pat. No. 9,502,835 discloses a radio frequency (RF) electrical connector comprising an insulative base, a fixed terminal secured to the insulative base, and a movable terminal including a securing portion fixed to the insulative base, a connecting portion, a contacting portion in touch with the fixed terminal, a first and a second beams at two opposite sides of the connecting portion, and a tail, wherein both the first and second beams are substantially perpendicular to the connecting portion.

SUMMARY OF THE INVENTION

An electrical connector comprises: an insulative base; a fixed terminal secured to the insulative base; and a movable terminal including a securing portion fixed to the insulative base, a connecting portion, a contacting portion in touch with the fixed terminal, a first and a second beams at two opposite sides of the connecting portion, and a tail, wherein at least one of the first and second beams has a first portion substantially perpendicular to the connecting portion and a second portion substantially parallel to the connecting portion.

DETAILED DESCRIPTION OF THE PREFERRED EMBODIMENTS

Figure 1:
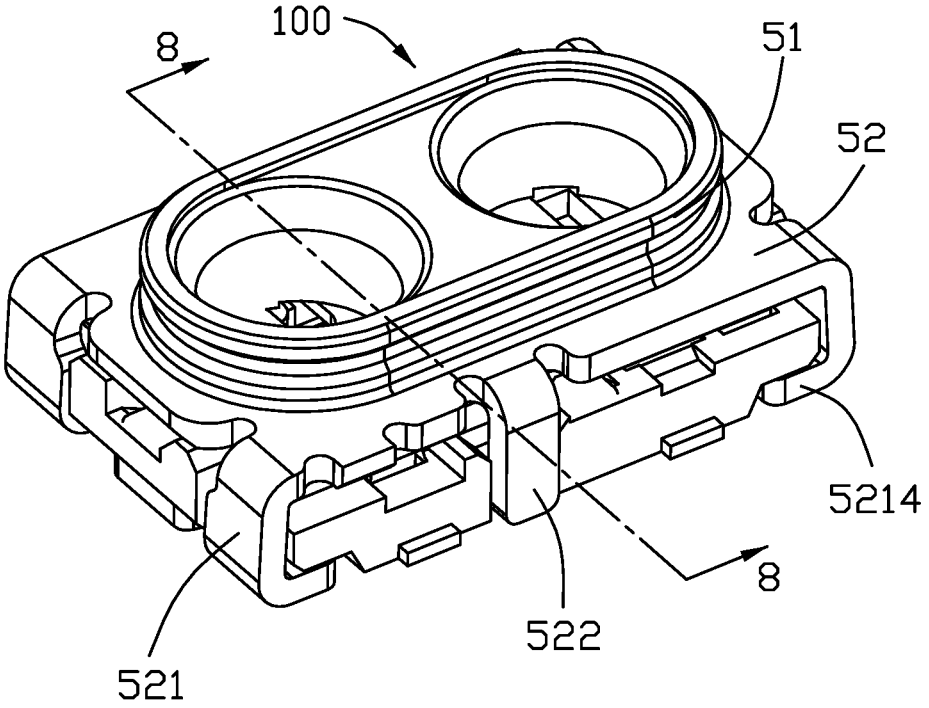
FIG. 1 is a perspective view of an electrical connector in accordance with a first embodiment of the present invention.
Figure 2:
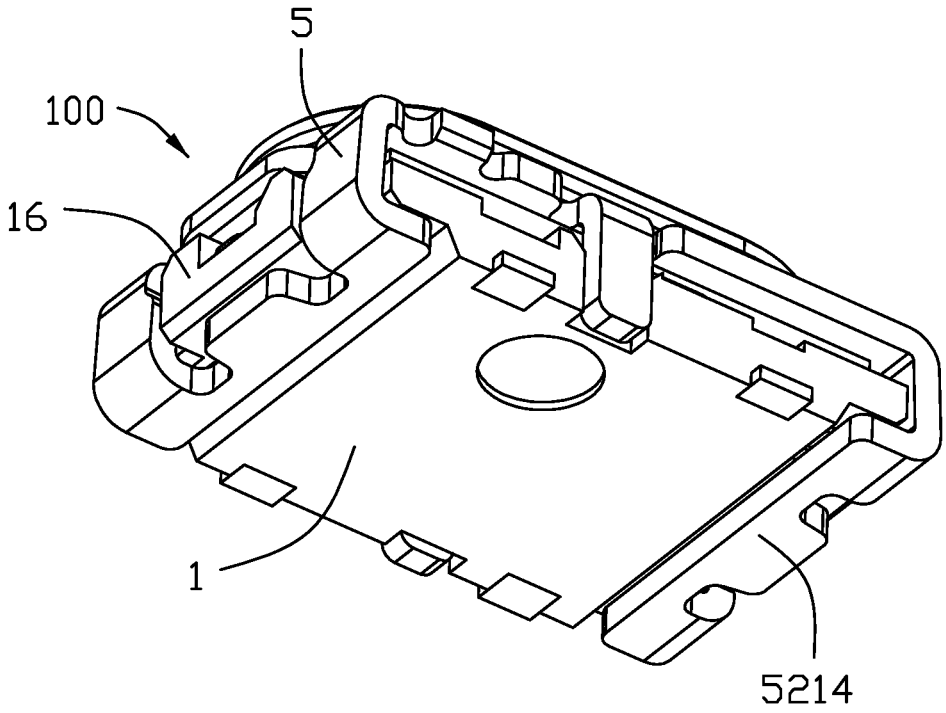
FIG. 2 is another perspective view of the electrical connector.
Figure 3:
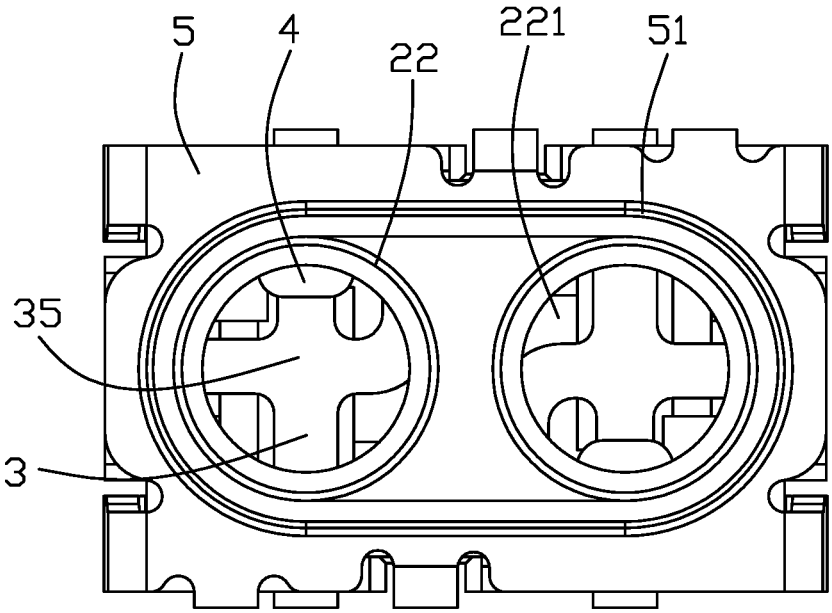
FIG. 3 is a top plan view of the electrical connector.
Figure 4:
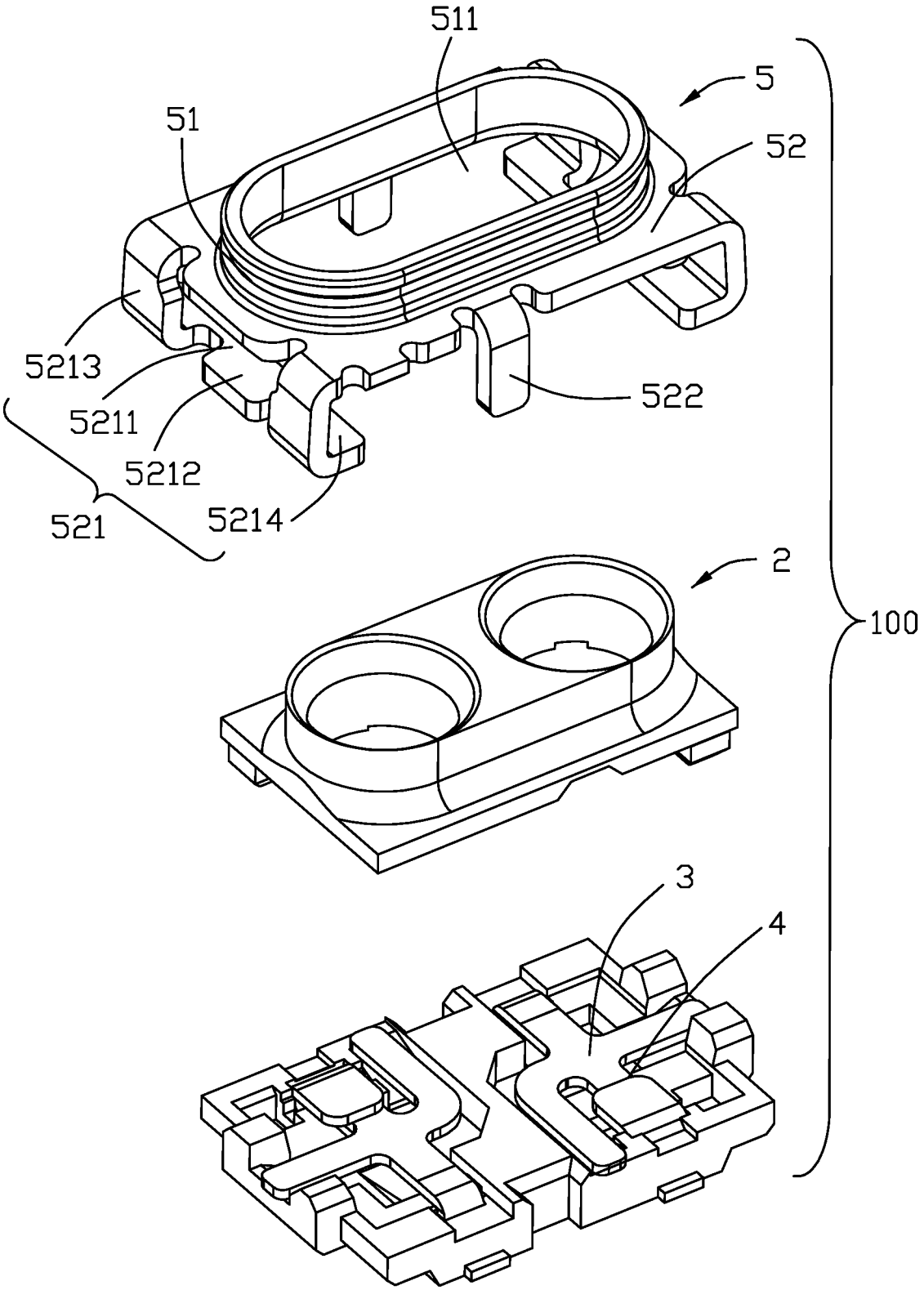
FIG. 4 is an exploded view of the electrical connector.
Figure 5:
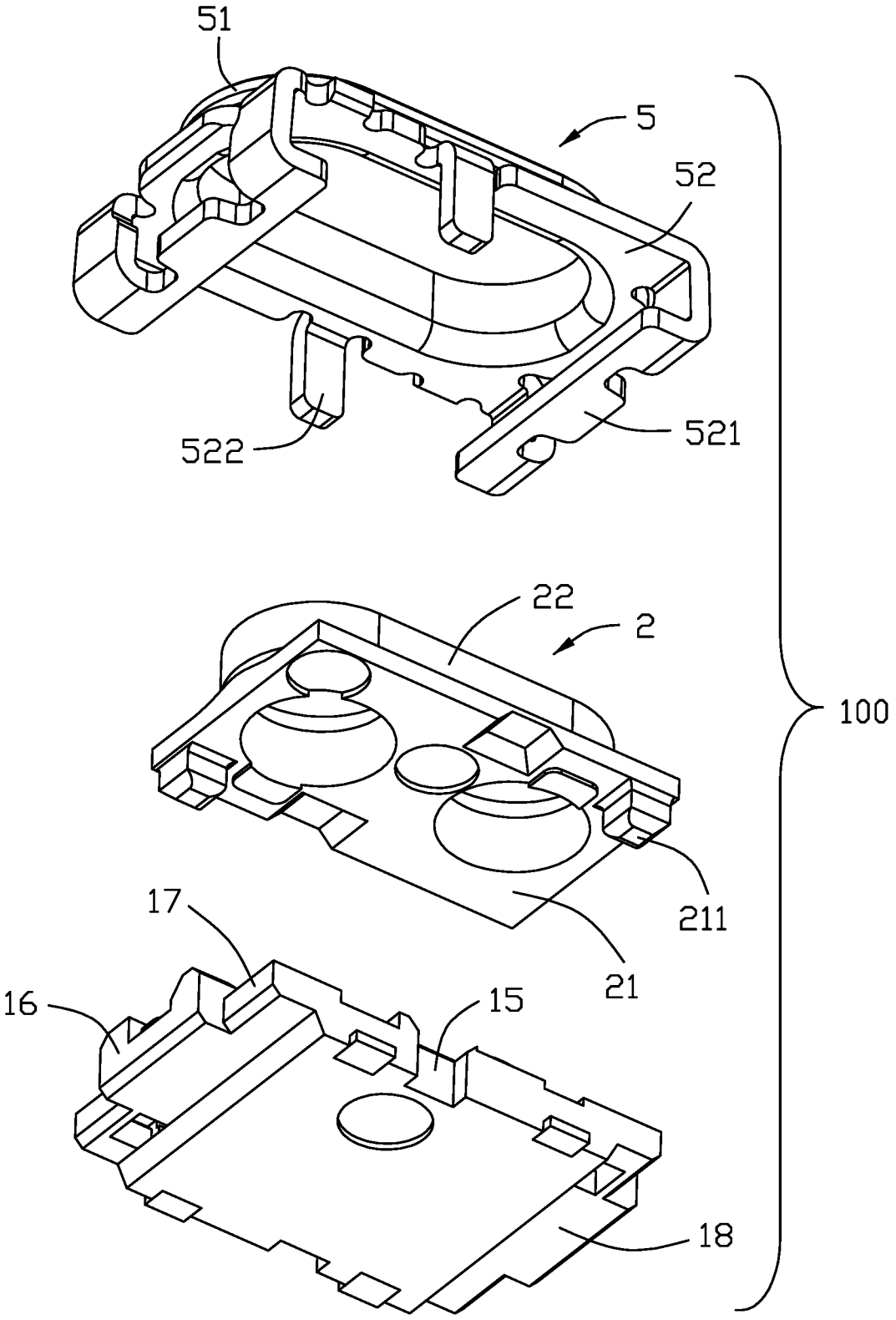
FIG. 5 is another exploded view of the electrical connector.
Figure 6:
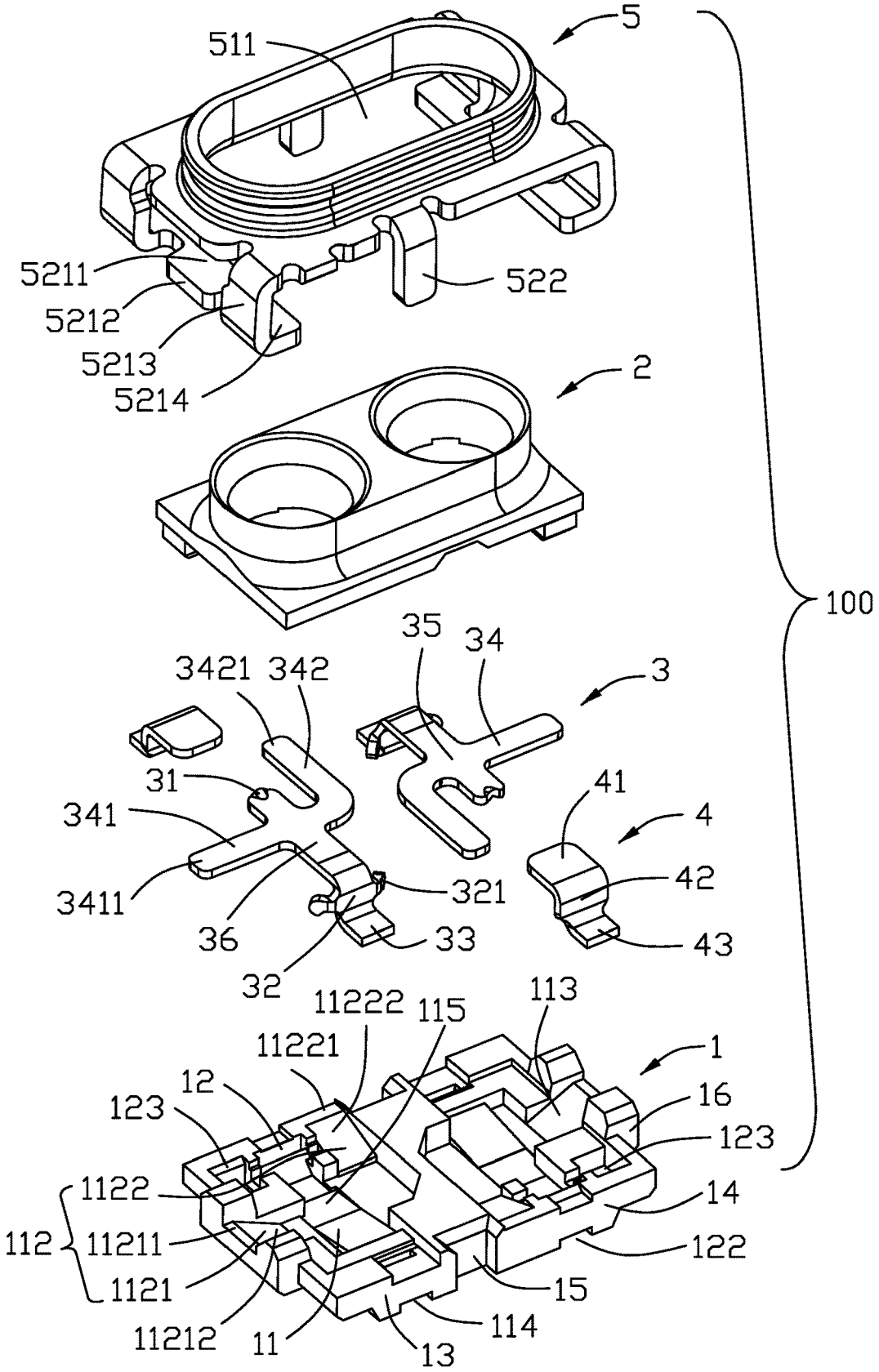
FIG. 6 is a further exploded view of the electrical connector in FIG. 4.
Figure 7:
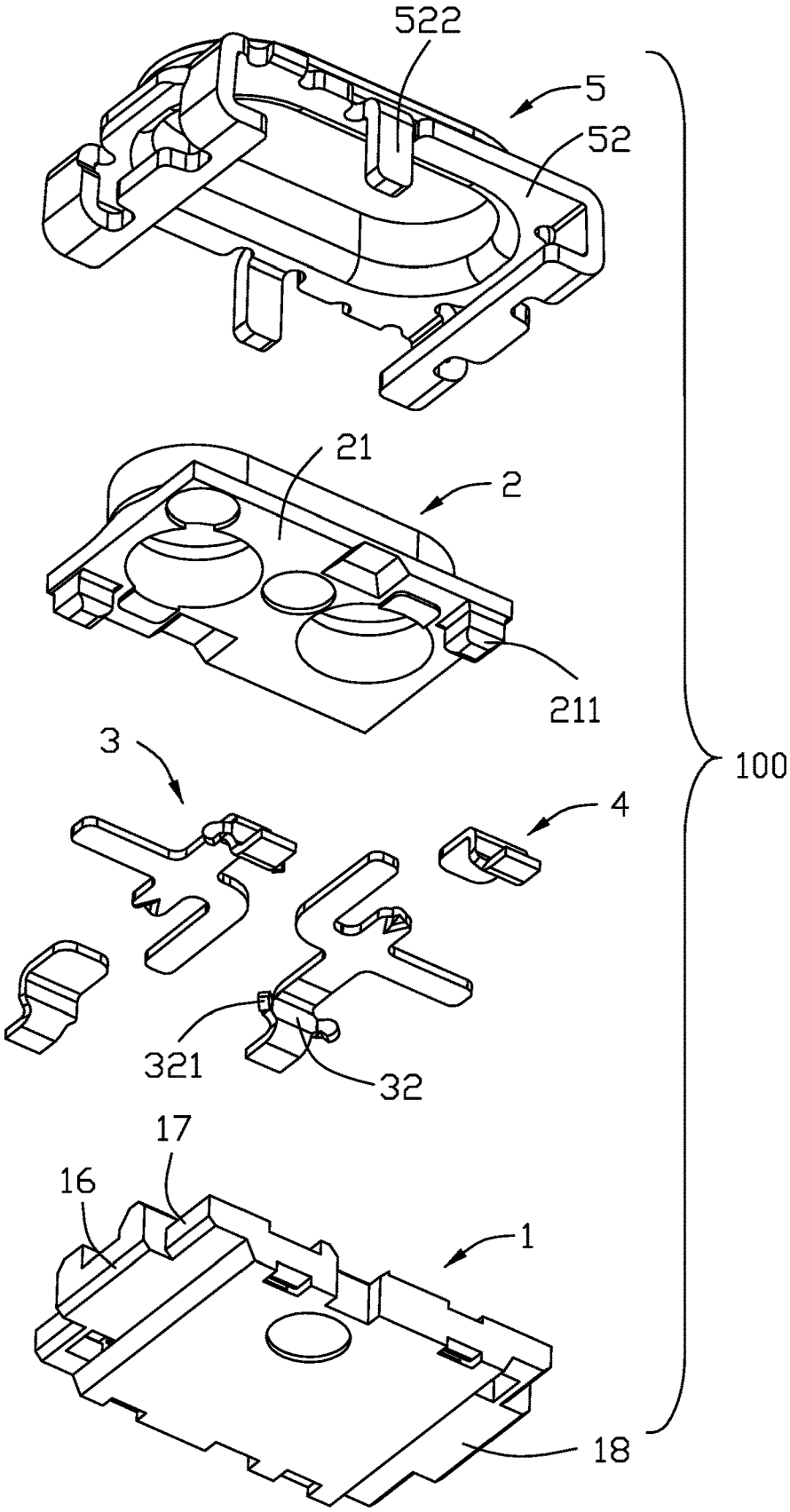
FIG. 7 is a further exploded view of the electrical connector in FIG. 5.
Figure 8:
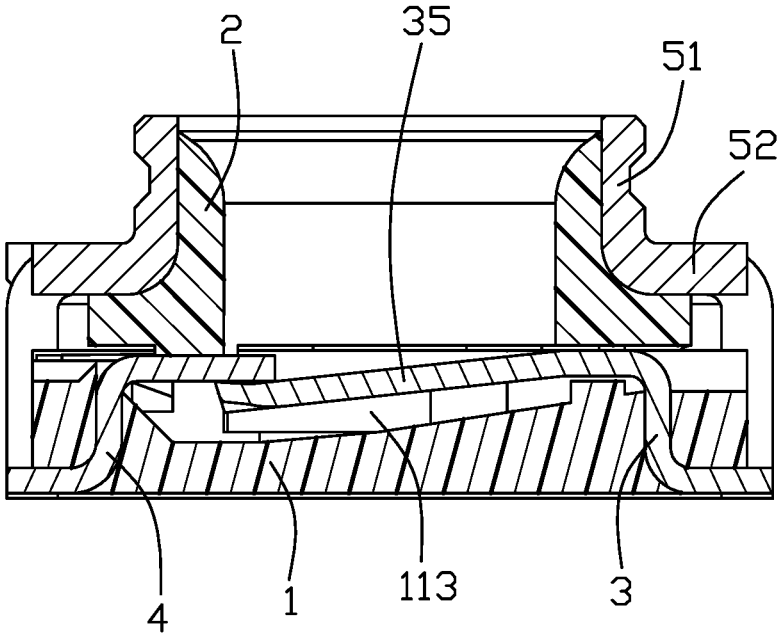
FIG. 8 is a cross-sectional view of the electrical connector taken along line A-A in FIG. 1.

Referring to FIGS. 1-8, an RF electrical connector 100 of the first embodiment comprises an insulative base 1 and a respective pair of movable terminals 3 and fixed terminals 4 insert-molded with the insulative base 1. The movable terminal 4 and the fixed terminal 3 are normally closed, i.e., in touch with each other. The electrical connector 100 may further comprise an insulative cover 2 secured to the insulative base 1 and an outer metallic shell 5 enclosing the insulative cover 2 and the insulative base 1.

The insulative base 1 includes a first part 13 and a second part 14 that are reversely symmetrically configured relative to each other with two notches 15 formed therebetween. Since the first part 13 and the second part 14 are of same configuration, only the first part 13 will be detailed below. The first part 13 has a groove 11 for the movable terminal 3, a groove 12 for the fixed terminal 4, and a groove 112. The groove 11 has a bottom region 115. A space 113 for up-and-down movement is defined between the movable terminal 3 and the groove 112. The first part 13 further has a positioning hole 123, a lug 16, a pair of notches 17 beside the lug 16, and a bottom abutment 18. The first part 1 further has a slot 114 and a slot 122 at two opposite ends thereof.

The insulative cover 2 has a base 21, a mating protrusion 22 with holes 221, and bottom posts 211.

The fixed terminal 4 has a securing portion 42, a soldering tail 43, and a contacting portion 41. The contacting portion 41 is bent to its position after the fixed terminal 3 is insert-molded with the insulative base 1 so as to achieve an accurate positioning of the contacting portion 31 relative to the movable terminal 3.

The movable terminal 3 has a securing portion 32 fixed in the groove 11 of the insulative base 1, a connecting portion 36, a contacting portion 31 in touch with the fixed terminal 4, and a tail 33. The movable terminal 3 further has two beams 34, namely, a first beam 341 and a second beam 342, at two opposite sides of the connecting portion 36. Free ends of the first and second beams 341 and 342 are supported by the groove 112. The securing portion 32 may include a pair of side arms 321 bent toward the fixed terminal 4 and insert-molded with the insulative base 1. Each of the pair of side arms 321 is substantially vertical and is bent about 45 degrees.

The first beam 341 is substantially perpendicular to the connecting portion 36 and has a free end 3411. The second beam 342 includes a first portion substantially perpendicular to the connecting portion 36 and a second portion substantially parallel to the connecting portion 36 and has a free end 3421. The groove 112 includes a first portion 1121 associated with the first beam 341 and a second portion 1122 associated with the second beam 342. The first portion 1121 of the groove 112 has an end region 11211 for supporting the free end 3411 of the first beam 341 and a sloped region 11212. Similarly, the second portion 1122 of the groove 112 has an end region 11221 for supporting the free end 3421 of the second beam 342 and a sloped region 11222. The end regions 11211 and 11221 are located at outer edges of the insulative base 1.

Between the first and second beams 341 and 342 on the contacting portion 31 is a pressing portion 35 for being pressed by a probe inserted through the hole 221.

Since the first and second parts 13 and 14 are reversely symmetrically configured, the two movable terminals 3 are also so configured, and so are the two fixed terminals 4, thereby reducing a size of the electrical connector 100. Moreover, the second beam 342 may maintain its length and therefore have a desired mechanical property.

Figure 9:
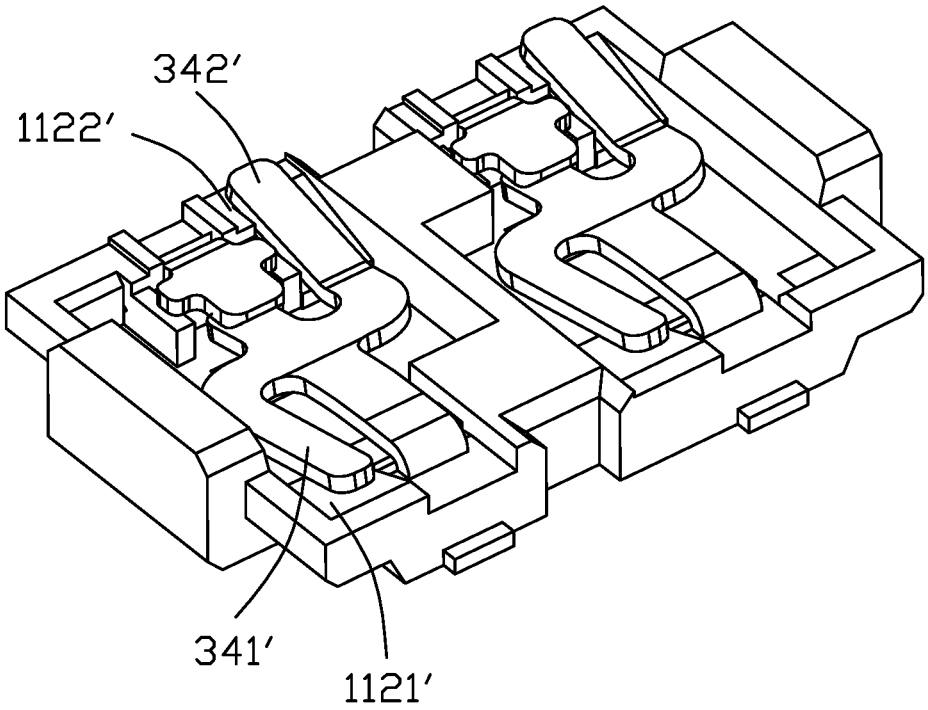
FIG. 9 is a perspective view showing part of an electrical connector in accordance with a second embodiment of the present invention.
Figure 10:
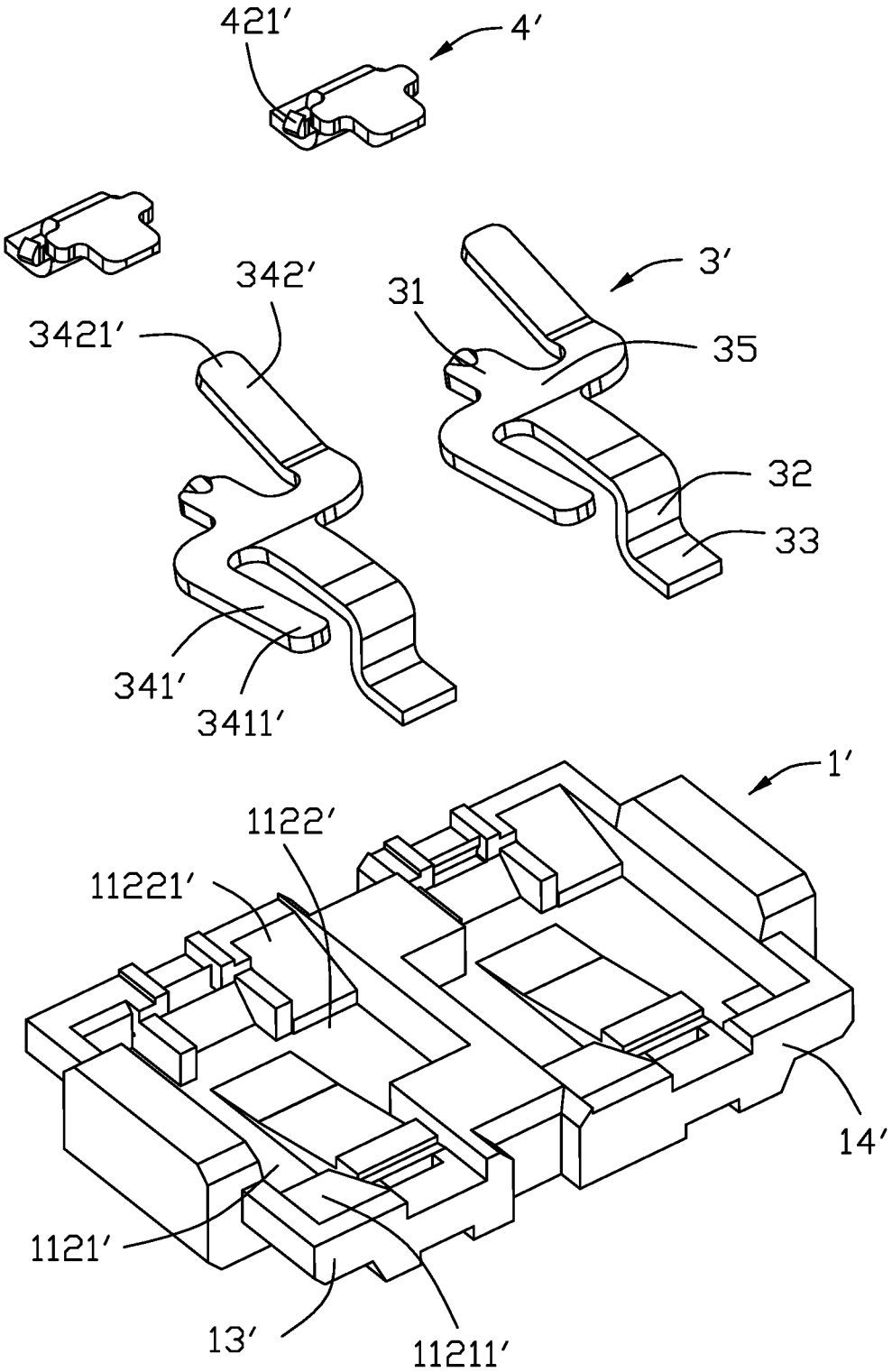
FIG. 10 is an exploded view of the electrical connector in FIG. 9.

Referring to FIGS. 9 and 10, an electrical connector of the second embodiment differs from the electrical connector 100 of the first embodiment in that a first beam 341' also includes a first portion substantially perpendicular to the connecting portion 36 and a second portion substantially parallel to the connecting portion 36 and has a free end 3411', just like a second beam 342' having similarly configured first and second portions and a free end 3421'. Moreover, the second portions of the first and second beams 341' and 342' extend in opposite directions, or two adjacent second portions of two terminals 3' extend in opposite directions. For each terminal 3', a corresponding groove portion 1121' with an end region 11211' is configured for the first beam 341' and a corresponding groove portion 1122' with an end region 11221' is configured for the second beam 342'. The end regions 11211' and 11221' are located at outer edges of an insulative base 1'.

Figure 11:
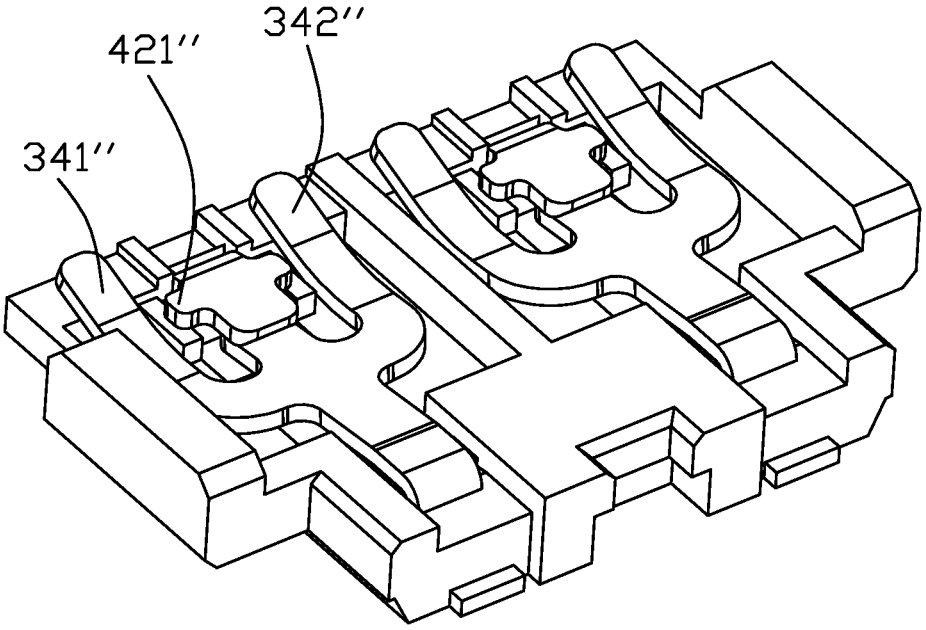
FIG. 11 is a perspective view showing part of an electrical connector in accordance with a third embodiment of the present invention.
Figure 12:
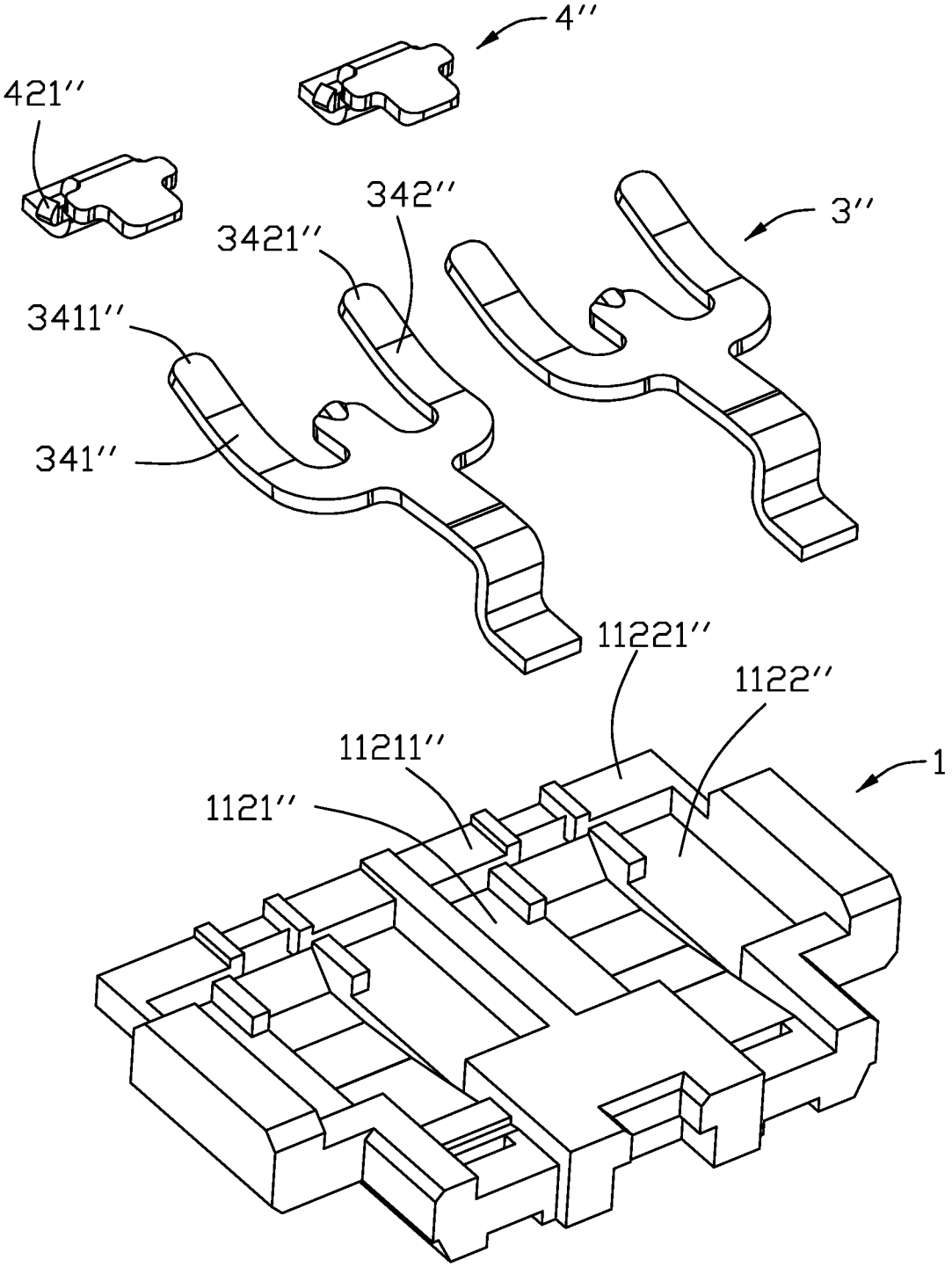
FIG. 12 is an exploded view of the electrical connector in FIG. 11.

Referring to FIGS. 11 and 12, an electrical connector of the third embodiment differs from the electrical connector 100 of the first embodiment in that a first beam 341" also includes a first portion substantially perpendicular to the connecting portion 36 and a second portion substantially parallel to the connecting portion 36 and has a free end 3411", just like a second beam 342" having similarly configured first and second portions and a free end 3421". Moreover, the second portions of the first and second beams 341" and 342" extend in same direction, or two adjacent second portions of two terminals 3" extend in same direction. For each terminal 3", a corresponding groove portion 1121" with an end region 11211" is configured for the first beam 341" and a corresponding groove portion 1122" with an end region 11221" is configured for the second beam 342". The end regions 11211" and 11221" are located at outer edges of an insulative base 1".

The outer metallic shell 5 has a base 52, a socket 51, and a pair of retaining portions 521 bent from the base 52. Each retaining portion 521 has a through hole 5211, a protrusion 5212, a pair of flaps, and a claw 5214. The outer metallic shell 5 may further include a pair of legs 522.

What is claimed is:

1. An electrical connector comprising:

an insulative base;

a pair of fixed terminals secured to the insulative base; and a pair of movable terminals each including a securing portion fixed to the insulative base, a connecting portion, a contacting portion in touch with a corresponding fixed terminal, a first and a second beams at two opposite sides of the connecting portion, and a tail; wherein at least one of the first and second beams of each movable terminal has a first portion substantially perpendicular to the connecting portion and a second portion substantially parallel to the connecting portion; and two adjacent second portions of the first and second beams extend in opposite directions.

2. The electrical connector as claimed in claim 1, wherein respective free ends of the first and second beams are located at outer edges of the insulative base.

3. The electrical connector as claimed in claim 1, further comprising an insulative cover secured to the insulative base and covering the fixed terminal and the movable terminal.

4. The electrical connector as claimed in claim 3, further comprising an outer metallic shell enclosing the insulative cover and the insulative base.

* * * * *